US006273059B1

(12) United States Patent
Wagner

(10) Patent No.: US 6,273,059 B1
(45) Date of Patent: Aug. 14, 2001

(54) DECELERATOR DEVICE MOUNTED IN THE EXHAUST GAS CIRCUIT OF A VEHICLE EQUIPPED WITH A COMBUSTION ENGINE

(75) Inventor: Pierre-André Wagner, Mulhouse (FR)

(73) Assignee: Fowa le Frein Moteur S.A., Wittenheim (FR)

( * ) Notice: Subject to any disclaimer, the term of this patent is extended or adjusted under 35 U.S.C. 154(b) by 0 days.

(21) Appl. No.: 09/446,421

(22) PCT Filed: Apr. 22, 1999

(86) PCT No.: PCT/FR99/00965

§ 371 Date: Dec. 20, 1999

§ 102(e) Date: Dec. 20, 1999

(87) PCT Pub. No.: WO99/54611

PCT Pub. Date: Oct. 28, 1999

(30) Foreign Application Priority Data

Apr. 22, 1998 (FR) ..... 98 05212

(51) Int. Cl.[7] ..... F02D 9/06

(52) U.S. Cl. ..... 123/323; 60/324; 188/273

(58) Field of Search ..... 123/323; 60/324; 188/273

(56) References Cited

U.S. PATENT DOCUMENTS 4,669,585 6/1987 Harris ..... 188/273
5,372,109 * 12/1994 Thompson et al. ..... 123/323

FOREIGN PATENT DOCUMENTS 1103682 3/1961 (DE) .
2481367 10/1981 (FR) .
08261021 10/1996 (JP) .
9-53473 * 2/1997 (JP) .

* cited by examiner

*Primary Examiner*—Tony M. Argenbright
(74) *Attorney, Agent, or Firm*—Davis & Bujold, P.L.L.C.

(57) ABSTRACT

A decelerator device for obtains constant and maximal decelerating power whatever the engine speed, by controlling the pressure of the gases upstream of the valve by balancing the efforts at the actuator cylinder rod. The decelerator device (1) includes a balancing device (25) incorporated in the actuator cylinder (9), cylinder rod (12) dissociated from the piston (11) and a calibrated spring member (26) mounted between them. When the valve (7) is closed and, based on a counter-pressure predetermined by the spring member calibration, the actuator rod (12) moves back by stroke C' which causes the valve (7) to open by an angle generating a leakage of the exhaust gases. Beyond the. threshold, the valve (7) reopening angle varies according the exhaust gas pressure thereby ensuring a constant and maximal counter-pressure whatever the engine speed. The invention is applicable to combustion engines and in particular to industrial vehicles.

20 Claims, 5 Drawing Sheets

DECELERATOR DEVICE MOUNTED IN THE EXHAUST GAS CIRCUIT OF A VEHICLE EQUIPPED WITH A COMBUSTION ENGINE

The present invention relates to a decelerator device mounted in the exhaust gas circuit of a vehicle equipped with a combustion engine, comprising at least one valve provided with a movable shutter and this shutter's actuator cylinder, this cylinder comprising a movable piston provided with a rod coupled to said movable shutter, and comprising at least one device for balancing the back pressure exerted by the shutter on the gas, this balancing device being designed to go into action when the shutter (7) is in the closed position and when a predetermined back pressure threshold is reached and to open the shutter (7) again to a degree of reopening I as soon as the back pressure reaches said threshold, so as to create a suitable exhaust gas leak rate so as to regulate this back pressure whatever the engine's speed.

BACKGROUND OF THE INVENTION

This type of decelerator is well known, particularly in the field of industrial vehicles equipped with a combustion engine. Taking into account their high inertia, in addition to their own braking system, these vehicles require a decelerator device housed in the exhaust gas circuit, preferably between the engine and the silencer, and generally mounted on the outlet side of the turbocompressor fed by the exhaust head. It is usually controlled by a pedal activated by the driver's left foot to prevent the latter from disengaging the clutch at the same time. This decelerator device makes it possible to generate a back pressure in the exhaust circuit. This back pressure is high or low depending on the position of the shutter and its degree of reopening. It has the effect of slowing down the engine and therefore provides additional braking of the vehicle. The higher the back pressure is, the more efficient the deceleration is. However, this back pressure has to be limited to the maximum set-point pressure allowable by the exhaust head, in order to prevent the reopening of the inlet valves. This back pressure of course depends on the exhaust gas pressure exerted on the shutter which is an asymptotic function of the engine speed. Consequently, there is a level of back pressure and therefore a deceleration level which corresponds to each engine speed. What is currently being sought is to make this function constant and at most equal to the maximum allowable set-point pressure whatever the engine speed and right from the low speeds, with the aim of optimizing the deceleration.

One of the techniques proposed is described in the publication EP-A-536 284 in which an exhaust modulator device comprises two leak holes closed by spring blades with different rigidities, in a shutter. When a first level of back pressure is reached, a first spring blade opens a first leak hole and releases part of the exhaust gas. A second leak hole thus increases the exhaust gas flow rate. This device makes it possible to limit the back pressure but generates deceleration stages. It is therefore not optimum. Furthermore, the spring blades are subject to temperature constraints and to the corrosion due to the exhaust gas. As a result, the way they operate deteriorates in time, thus affecting their performance when opening and closing. Indeed, under the heat of the exhaust gas, the spring blades become less rigid and the holes will always stay open, thus reducing the back pressure and the deceleration efficiency. What is more, as the modulation system is incorporated into the shutter, it is impossible to offer it as part of the after-sales service to equip decelerator devices already in service.

Another technique is described in the publication FR-A-2 481 367 which provides for a device to balance the back pressure, which is mounted at the end of the cylinder rod and coupled to the shutter's lever by means of a ball joint. This device is therefore located outside and protrudes. It is consequently subject to the external attacks in the engine environment, i.e. splashes of water, mud, salt, oil, etc. What is more, it represents a by no means insignificant mass at the end of the rod, which causes premature wear and tear on the cylinder and a danger of the rod breaking but also generating a considerable increase in this rod's inertia, and therefore in the decelerator's opening and closing times. This device requires a part which is specifically adapted on the cylinder's rod, the latter only being guided in translation over a very small span which is able to cause a risk of blocking.

The publication U.S. Pat. No. 4,669,585 describes a technique which is similar to the one above but adapted to a slide valve, whose overall height is much greater than that of a butterfly valve. The device for balancing the back pressure comprises an opening in the shutter sealed by a plate coupled to the end of a cylinder rod which can slide in the piston against the action of a spring when the back pressure reaches a certain threshold. This plate only offers the exhaust gas a small contact surface, which reduces the decelerator's efficiency. Furthermore, this device is subject to direct attacks from the exhaust gas and can, as a result, become jammed or be damaged prematurely, which reduces the device's reliability. This device is also complex and expensive to implement. It is also subject to parasitic forces, the back pressure acting perpendicular to the movement of said plate which further reduces the device's efficiency and reliability.

SUMMARY OF THE INVENTION

The aim of the present invention is to improve current decelerator devices by proposing a device for balancing the back pressure which is simple, compact, costs less, and makes it possible to achieve constant and maximum deceleration performances whatever the engine's speed whilst ensuring reliability and operating stability in time, without any risk of damage due to the attacks of the exhaust gas and the high temperature, protected from any attack outside the engine (splashes of water, mud, salt, oil, etc.), and without affecting the decelerator's inertia and therefore the efficiency of the shutter when opening and closing. Another aim is to be able to equip both easily and at reduced cost decelerator devices already in service by being marketed as an after-sales product.

This aim is achieved by a decelerator device having the balancing device is incorporated into the actuator cylinder and arranged between two distinct coaxial parts of the cylinder rod, one part at least being designed to move at a stroke C' in relation to the other, this stroke C' corresponding to the degree of reopening I and being controlled by at least one calibrated spring device arranged between the two distinct parts of this rod.

The gas pressure upstream from the shutter is thus controlled by balancing the forces at the actuator cylinder. As a result, the function of balancing the pressures is separated from the decelerator function and incorporated into the cylinder, allowing the balancing device to not be exposed both to attacks by the gas and the high temperature in the exhaust circuit, and to the engine environment subject to external attacks (splashes of various kinds) and thus ensure long-term efficient and reliable operation.

In a preferred form of embodiment of the invention, one of the parts is made up of the movable piston and the other part is comprised of the rod itself The piston may comprise a coaxial cavity and the rod may comprise a head housed in said cavity, the calibrated spring device being arranged in the cavity at the rear of the head.

Preferably, the piston is comprised of two assembled parts, the cavity extending inside the two parts.

Advantageously, the spring device is calibrated to such a value that it is compressed when a force corresponding to said predetermined threshold of back pressure is reached.

The maximum stroke C' of the cylinder rod may lie between 0 and 10 mm (0 and 0.394 )inch and is preferably equal to 5 mm(0.197 )inch.

In the preferred form of embodiment, the shutter is rotary and the degree of reopening I is an angle $\alpha$, the maximum value of which is between 0 and 20° and preferably equal to 10°.

Advantageously, the cavity presents a length at least equal to the sum of the length of the calibrated compressed spring device, the thickness of the rod's head and the rod's maximum stroke C'.

In the preferred form of embodiment, the axis of rotation A of the shutter is distinct from the axis of symmetry B of said shutter by a gap d, this gap d being between 0.5 and 5 mm(0.0197 and 0.197 )inch.

Advantageously, the cylinder comprises two distinct bearings, arranged to guide the rod axially, one bearing being provided in the piston and the other bearing in a fixed ring which closes the cylinder's liner.

BRIEF DESCRIPTION OF THE DRAWINGS

The present invention and its advantages shall be more fully disclosed in following the description of a form of embodiment given by way of an unrestricted example and with reference to the attached drawings, in which.

DESCRIPTION OF THE PREFERRED EMBODIMENTS

Figure 1:
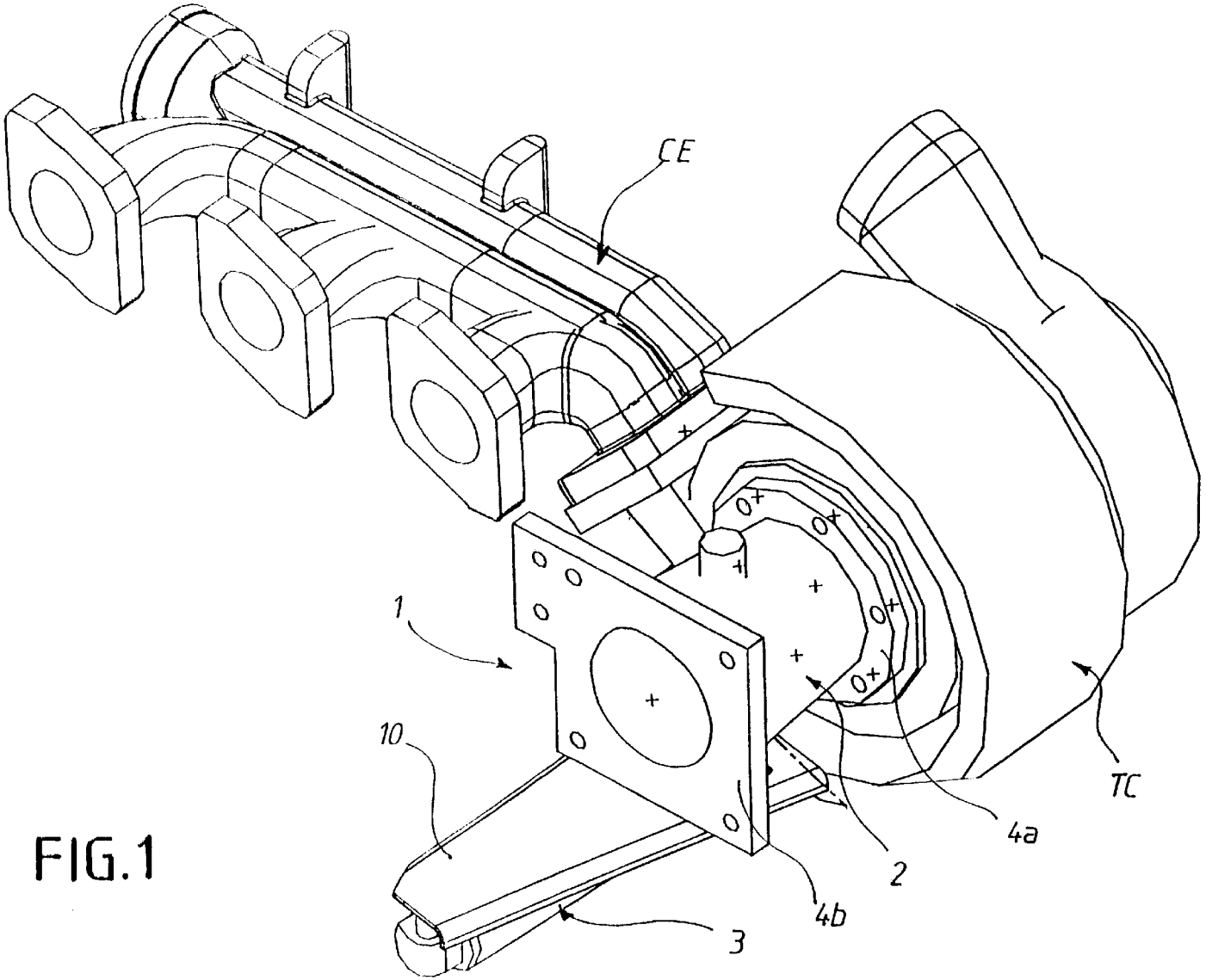
FIG. 1 represents an overall perspective view of a decelerator device according to the invention mounted on the outlet side of a turbocompressor.

With reference to FIG. 1, the decelerator device 1 according to the invention is mounted in the standard way in the exhaust circuit of a vehicle which is generally industrial and equipped with a combustion engine, on the outlet side of a turbocompressor TC fed by an exhaust head EH which recovers the gas from said engine (not shown).

Figure 2:
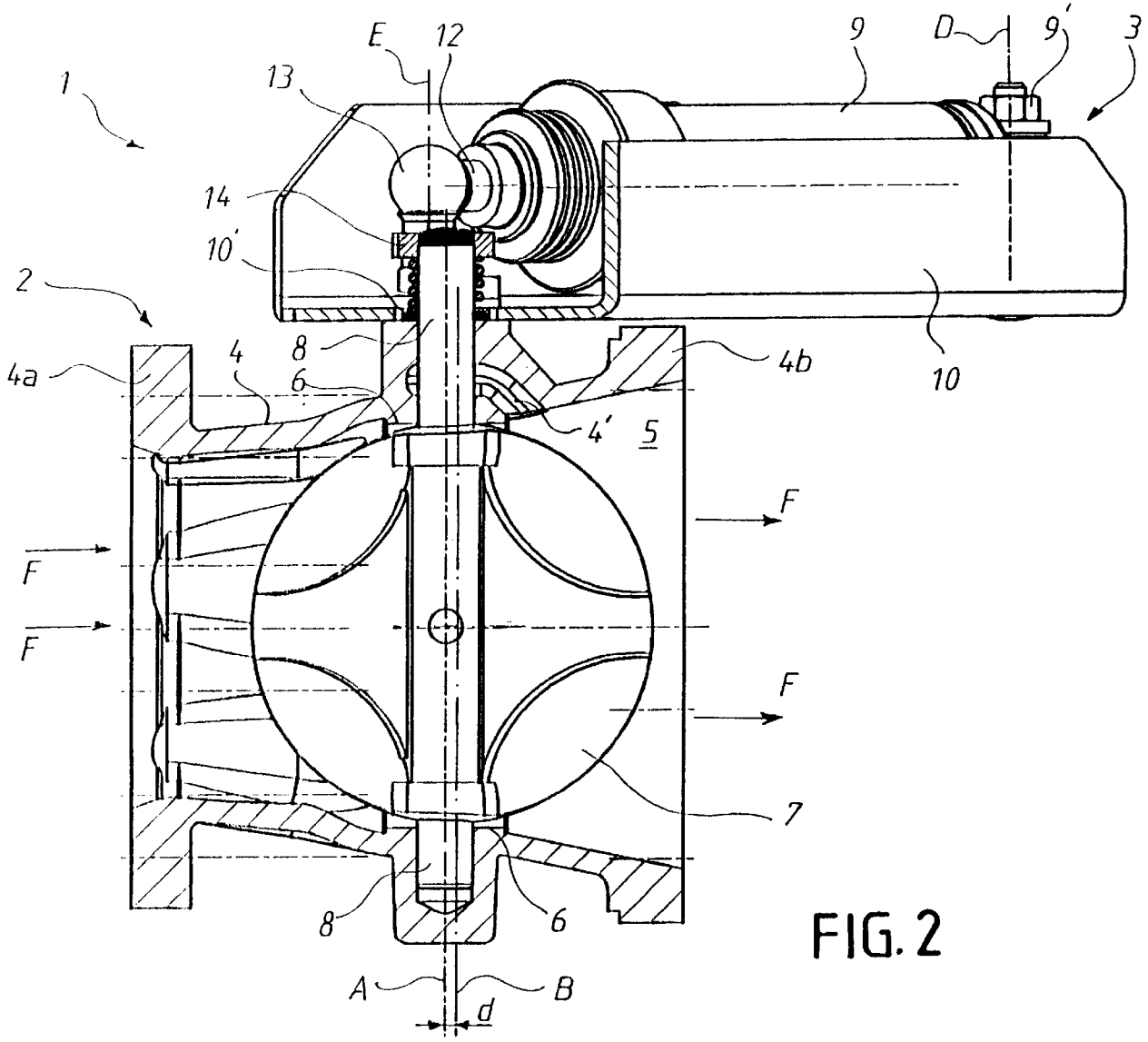
FIG. 2 is an axial cutaway view of the decelerator device according to the invention.

With reference to FIG. 2, the decelerator device 1 comprises a valve 2 controlled by a control device 3. The valve 2 comprises a body 4 defining a channel 5 for the exhaust gas to pass in the direction of the arrows F and a bore 6 for a movable shutter 7 mounted in said body 4 at right angles to said channel 5 designed to retain the gas upstream when it is in the closed position. The body 4 comprises at its ends two mounting flanges 4*a*, 4*b* designed to receive, upstream, a corresponding flange from the turbocompressor TC and, downstream, a corresponding flange from the exhaust pipe (not shown). Of course, according to the type of decelerator, the mounting flanges 4*a*, 4*b* can be replaced by any other equivalent device such as clamping collars, etc. The movable shutter 7, which is shown, is a butterfly valve mounted on a shaft 8 with axis A, this shaft having an upper end which crosses said body 4 to be coupled to said control device 3. It can be noticed that the axis A corresponding to the axis of rotation of the butterfly valve 7 is distinct from the axis of symmetry B of said valve and at a distance d able to vary from 0.5 to 5 mm depending on the size of the decelerator. The reasons for this offsetting shall be explained later on. Of course, any other form of shutter can be imagined such as a plug, a ball or a slide valve. The body 4 of the valve 2 comprises a decompression vault 4' which is comprised of a bent conduit made by molding inside the body and located on the shaft 8 passage. This conduit has one blind upstream end arranged near the shaft 8 and one downstream end opening into the channel 5 downstream from the shutter. It ensures efficient tightness of the decelerator 1 between the shaft 8 and the body 4. Indeed, when the shutter 7 is closed, if exhaust gas infiltrates between these two parts, it is automatically diverted and evacuated via the conduit 4', which due to the difference in pressure between the upstream and downstream end of the shutter acts as an exhauster, hence its name : decompression vault.

The control device 3 is a cylinder 9, which can be hydraulic, pneumatic or electric, arranged outside said body 4 and therefore not subject to the exhaust gas. This cylinder 9 is mounted on a support 10 by a screw/nut system 9' defining a fixed axis D and comprises an inside movable piston 11 (cf FIGS. 3 to 5) provided with an outside rod 12 coupled to the shaft 8 of the shutter 7 by a ball joint 13 and a lever 14, the ball joint 13 defining an articulation axis E. When seen from above (cf FIGS. 3 to 5), the points corresponding to the axes A, D and E define a triangle which determines the opening and closing kinematics of the butterfly valve 7 as well as the lengths of the lever 14 and the cylinder's rod 12. These points must not under any circumstances be in a straight line. The support 10 of the cylinder 9 is positioned on the body 4 of the valve 2 and a seal 10' is provided around the shaft 8 to again avoid any risk the exhaust gas leaking outside the decelerator 1.

The decelerator device 1 is controlled by the driver of the industrial vehicle by means of a control pedal. When the vehicle is running normally, the decelerator device 1 is idle, therefore the shutter 7 is open (cf FIG. 3) allowing the gas to escape freely. During braking, the cylinder 9 is fed by a pressurized fluid, the rod 12 extends and causes the shutter 7 to close (cf. FIG. 4) thus retaining the gas and generating a back pressure which causes the engine to slow down and therefore a reduction in the vehicle's speed. It has to be specified that even in the closed position, the shutter 7 allows a small quantity of exhaust gas to escape to avoid any risk of blocking and excess pressure which is dangerous for the equipment located upstream.

Figure 3:
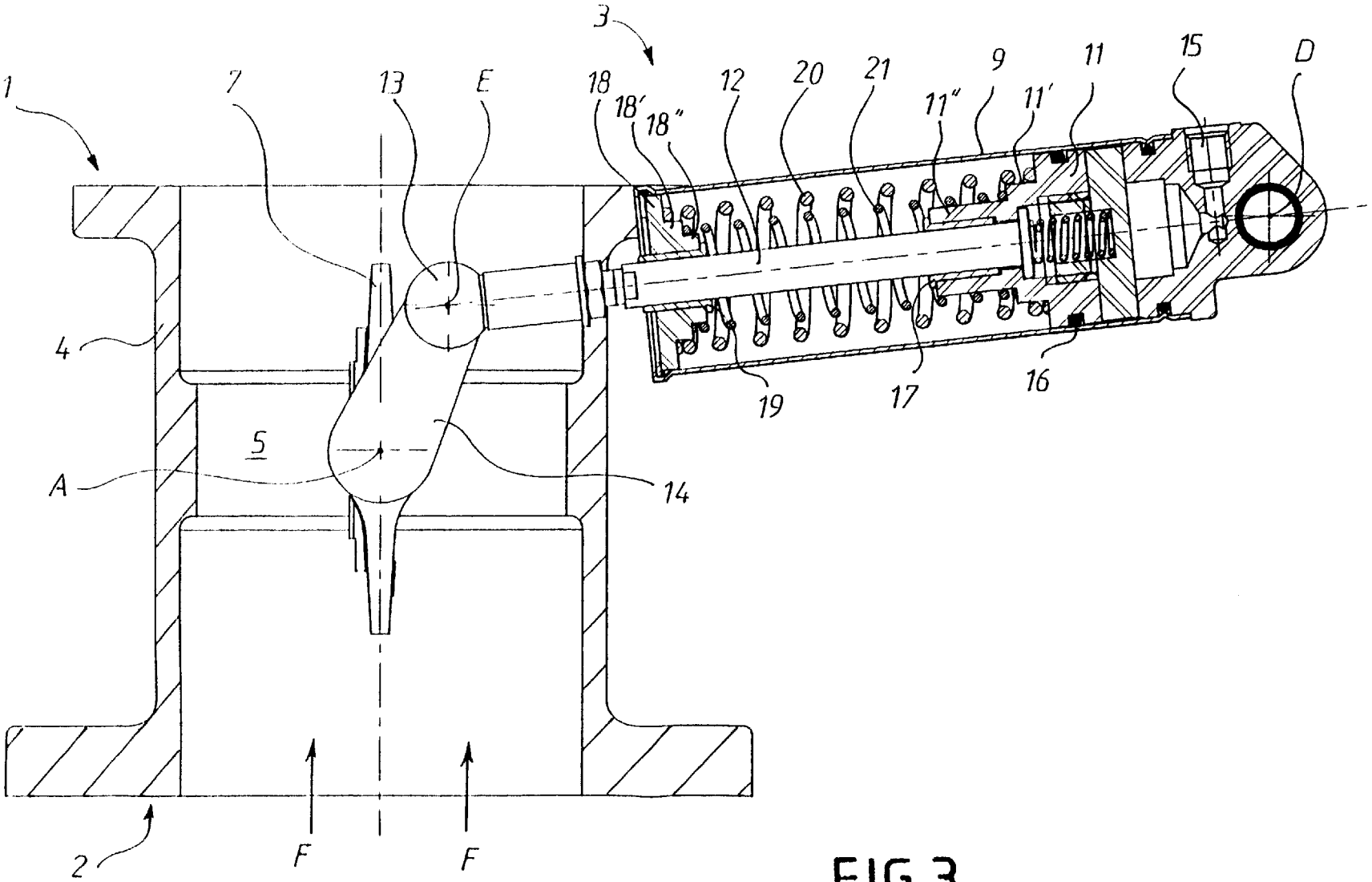
FIGS. 3 to 5 are cutaway top views showing the decelerator device respectively idle—the shutter open, working—the shutter closed and balanced—the shutter slightly open.
Figure 4:
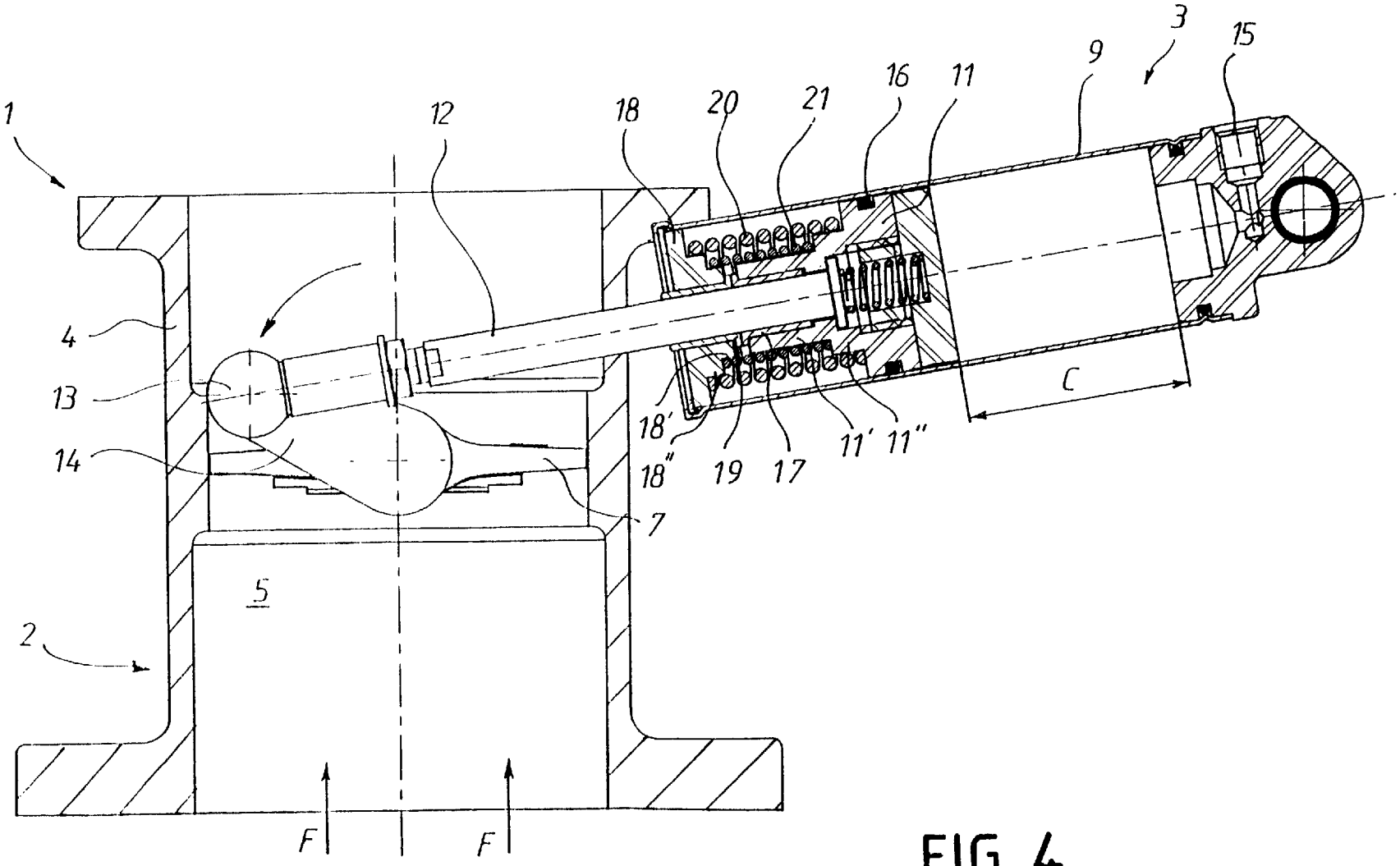
Figure 5:
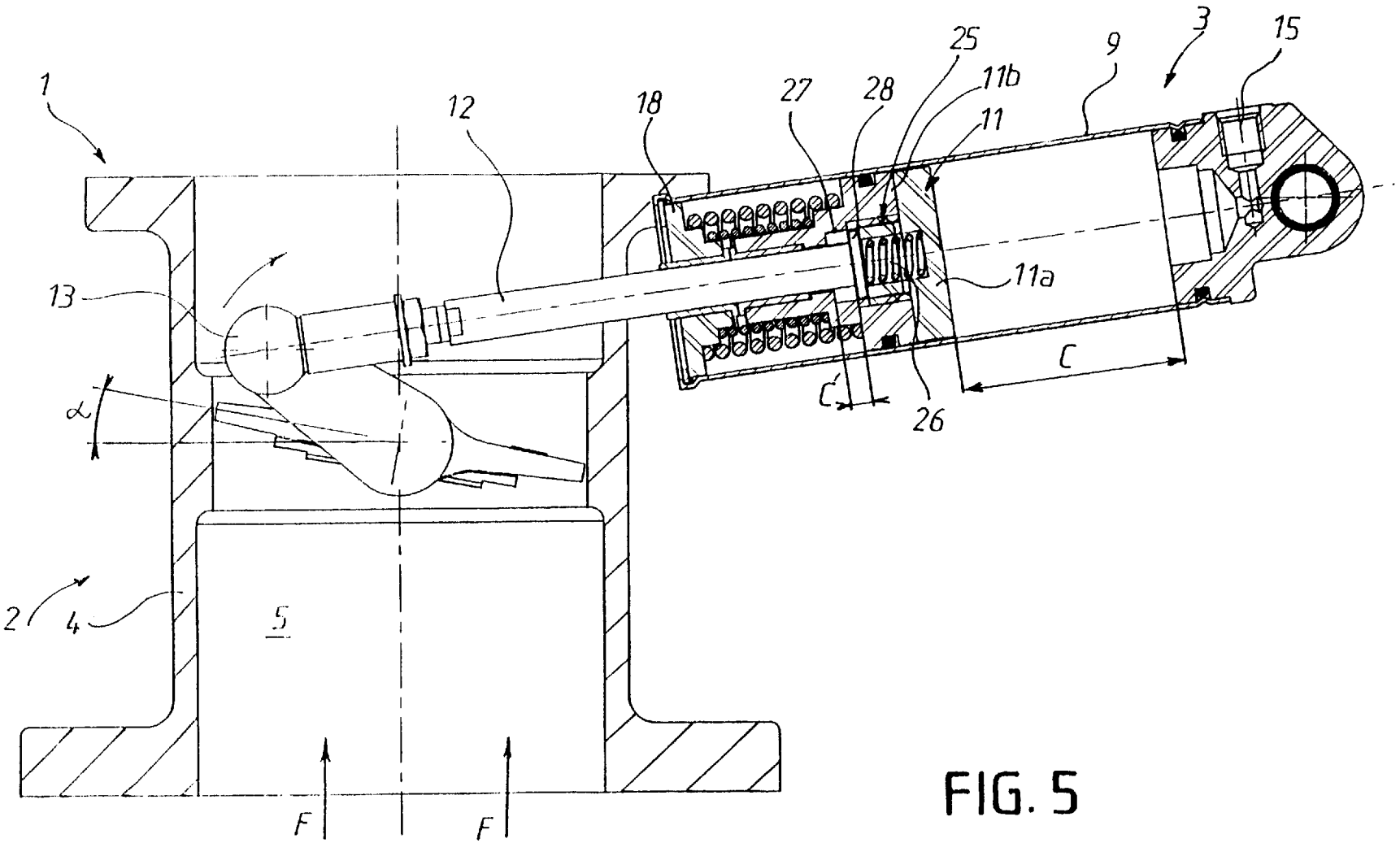

FIGS. 3 to 5 illustrate the various positions of the decelerator device 1 in a topview with the cutaway representation of the actuator cylinder 9.

FIG. 3 shows the decelerator device 1 in its idle position. The cylinder is not fed, the piston 11 is located close to orifice 15 supplying the pressurized fluid, the rod 12 is retracted and the shutter 7 is in the open position, i.e. directed parallel to the flow of the exhaust gas.

FIG. 4 shows the decelerator device 1 in its working position. The cylinder 9 is fed, the piston 11 moves at a stroke C, the rod 12 extends at the same stroke C causing the shutter 7 to pivot a quarter turn. The shutter 7 is then in the closed position i.e. oriented perpendicular to the flow of exhaust gas and generating the back pressure. As explained above, the shutter 7 and this shutter's bore 6 are designed to allow a small gas leak to escape. The piston 11 is mounted in the cylinder's liner 9 by a sealing ring 16 ensuring tightness and on the rod 12 by a bearing 17. A fixed ring 18 closes the cylinder's liner 9 and guides the rod 12 in a bearing 19. This rod 12 is therefore guided axially at both its ends by the two bearings 17, 19, which are self-lubricated and offer it a sufficient guideway to ensure that it moves uniformly, always in the axis and without any risk of blocking. Two superposed release springs 20, 21, placed in opposition and coaxial are provided between this fixed ring 18 and the piston 11 to bring the piston 11 back to the idle position as soon as the pressurized fluid stops being fed. These two release springs 20, 21 can also be replaced by a single release spring or by any equivalent means, according to the type of decelerator. The piston 11 is restricted in its stroke by a stop formed when the two bearings 17, 19 come into contact, the release springs 20, 21 being compressed. These release springs 20, 21 are determined in such a manner that when being compressed, their turns are never contiguous, in order to restrict these springs' fatigue and prevent them from forming said stop by themselves. These release springs 20, 21 are mounted and guided on corresponding shoulders 11', 11" and 18', 18" provided respectively on the piston 11 and the fixed ring 18.

FIG. 5 shows the decelerator device 1 in its balanced position. The cylinder 9 is still fed by the pressurized fluid, the piston 11 is in the same position as that in FIG. 4 and the rod 12 is extended. However, the pressure of the gas upstream from the shutter 7 has risen beyond a back pressure threshold, which is at most equal to the maximum allowable back pressure value and is determined by a balancing device 25 described hereinafter, which authorizes the partial reopening which is limited to a degree of reopening I of the shutter 7 to create a bigger gas outlet. In this configuration of the decelerator device 1, whatever the engine's speed, the shutter 7 goes into a balanced position limited by its degree of reopening I ensuring a constant and maximum slowing-down effect as it corresponds to the predetermined set-point back pressure which can be the maximum back pressure allowed by the exhaust head CE.

The balancing device 25 is incorporated and housed in the cylinder 9. It comprises the cylinder's rod 12 which is dissociated from the piston 11 and a calibrated spring device 26 inserted between the rod and the piston. The calibrated spring device 26 is, in this case, a compression spring but can be made up of any other suitable spring element. A cavity 27 is provided coaxially in the piston 11 to receive said spring device 26 and the corresponding end of the rod 12 forming a head 28 with a diameter greater than that of the rod. The length of the cavity 27 is at least equal to the sum of the length of the calibrated spring device 26 when compressed, the thickness of the rod's head 28 and a stroke C' corresponding to the return stroke of the rod 12. Incorporating the balancing device 25 into the cylinder 9 requires the embodiment of piston 11 in two parts 11*a*, 11*b* assembled by screwing them together or any other equivalent means, like for example crimping, the cavity 27 being provided inside the two parts.

In the normal position, the spring device 26 pushes the rod 12 which is stopped in translation by its head 28 resting on the bottom of the cavity 27. This spring device 26 is calibrated to withstand a force of pressure corresponding to the predetermined back pressure threshold at the shutter 7, less than or equal to the maximum back pressure allowable by the exhaust head CE. Beyond this threshold, the spring device 26 is compressed and allows the rod 12 to withdraw at the stroke C' under the effect of the exhaust gas pressure exerted on the shutter 7. For this purpose, and as mentioned previously, the axis of rotation A of the shutter 7 is offset in relation to its axis of symmetry B, thereby creating a torque allowing it to reopen under the thrust force caused by the exhaust gas. The stroke C' of the rod 12 allows the shutter 7 to reopen to a degree of reopening I, corresponding in this case, to an angle $\alpha$ thereby generating a greater exhaust gas leak rate. The maximum stroke C' is delimited by part 11*a* of the piston and the rod's head 28 when this head 28 abuts against the bottom of the cavity 27. Depending on the type of decelerator, it can be between 0 and 10 mm (0 and 0.394 inch) and preferably equal to 5 mm(0.197 inch), which corresponds to a maximum degree of reopening I, the maximum angle $\alpha$ of which lies between 0 and 20° and is preferably equal to 10°.

Whatever the engine's speed, this reopening angle $\alpha$ varies according to the exhaust gas pressure between its minimum and maximum values, 0 and 10° for example, which makes it possible to guarantee a back pressure which is constant and at most equal to the maximum set-point pressure allowed by the exhaust head CE. This balancing device 25 therefore makes it possible to control the gas pressure upstream from the shutter by balancing the forces at the rod 12 of cylinder 9.

It clearly emerges from this description that the invention makes it possible to improve current decelerator devices by proposing a balancing device 25 which is simple, inexpensive, effective, compact and incorporated into the actuator cylinder 9 which is offset in relation to the exhaust circuit. The decelerator and balancing functions are thereby dissociated. As a result, the actuator cylinder 9 equipped with the balancing device 25 and the balancing device itself are subject neither to high temperatures and attacks by the exhaust gas, nor to attacks from outside the engine. The balancing device 25 being incorporated into the cylinder 9 does not generate any parasitic force on the cylinder's rod able to have a negative influence on its reaction time when the shutter opens and closes. Furthermore, it can be offered as an after-sales product to equip existing decelerator devices and can be put in place very easily without having to dismantle the valve 2.

The present invention is not limited to the example of embodiment described but can be widened to include any modification or alternative which is obvious for the expert.

What is claimed is:

1. A decelerator device (1) mounted in an exhaust gas circuit of a vehicle equipped with a combustion engine, the decelerator device (1) comprising:

at least one valve (2) provided with a movable shutter (7) and an actuator cylinder (9) for operating the movable shutter (7), the actuator cylinder comprising a movable piston (11) provided with a rod (12) coupled to the movable shutter (7) to control operation of the movable shutter (7);

at least one balancing device (25) for balancing a back pressure exerted by the movable shutter (7) on gas flowing through the exhaust gas circuit, the at least one balancing device operates when the movable shutter (7) is in a closed position, once a predetermined back pressure threshold is reached within the exhaust gas circuit, to allow the movable shutter (7) to move to a partially reopened position (I) and create a suitable exhaust gas leak flow rate past the movable shutter (7) and regulate the back pressure regardless of a speed of the engine of the vehicle;

wherein the balancing device (25) is incorporated into the actuator cylinder (9) and is arranged between the movable piston (11) and the rod (12) of the cylinder, the rod (12) moves at stroke distance (C') relative to the movable piston (11), the stroke distance (C') of the rod corresponds to a degree of reopening of the movable shutter (7) and is controlled by at least one calibrated spring device (26) interacting between the movable piston (11) and the rod (12) of the cylinder.

2. A decelerator device (1) for mounting in an exhaust gas circuit of a vehicle equipped with a combustion engine, the decelerator device (1) comprising:

at least one valve (2) provided with a movable shutter (7) and an actuator cylinder (9) for operating the movable shutter (7), the actuator cylinder comprising a movable piston (11) provided with a rod (12) coupled to the movable shutter (7) to control operation of the movable shutter (7);

the actuator cylinder (9) comprising at least one balancing device (25) for balancing a back pressure exerted by the movable shutter (7) on gas flowing through an exhaust gas circuit, when the decelerator device (1) is mounted in an exhaust gas circuit of a vehicle equipped with a combustion engine; the at least one balancing device operates when the movable shutter (7) is in a closed position and once a predetermined back pressure threshold is reached within the exhaust gas circuit, when the decelerator device (1) is mounted in an exhaust gas circuit of a vehicle equipped with a combustion engine; and the at least one balancing device allows the movable shutter (7) to move to a partially reopened position (I), as soon as the back pressure reaches the predetermined back pressure threshold, to create a suitable exhaust gas leak flow rate by the movable shutter (7) and regulate the back pressure regardless of a speed of an engine of the vehicle equipped with the combustion engine;

wherein the balancing device (25) is incorporated into the actuator cylinder (9) and is located between the movable piston (11) and the rod (12) of the cylinder, the rod (12) moves at stroke distance (C') relative to the movable piston (11), the stroke distance (C') of the rod corresponds to a degree of reopening of the movable shutter (7) and is controlled by at least one calibrated spring device (26) interacting between the movable piston (11) and the rod (12) of the cylinder.

3. The device according to claim 2, wherein the movable piston (11) defines a cavity (27) and the rod (12) comprises a head (28) housed within the cavity, the calibrated spring device (26) is located within the cavity and engages an adjacent surface of the head.

4. The device according to claim 3, wherein the movable piston (11) comprises two separate parts (11*a*, 11*b*) which, when assembled with one another, together define the cavity (27).

5. The device according to claim 3, wherein the calibrated spring device (26) is calibrated so that the calibrated spring device (26) becomes at least partially compressed when a force, corresponding to the predetermined back pressure threshold, is reached.

6. The device according to claim 2, wherein a maximum stroke distance (C') of the rod (12) is between 0 and 0.394 inch.

7. The device according to claim 6, wherein the maximum stroke distance (C') of the rod (12) is 0.197 inch.

8. The device according to claim 6, wherein the movable shutter (7) is a rotary shutter, and the degree of reopening (I) of the movable shutter (7) is an angle ($\alpha$) of between 0 and 20 .

9. The device according to claim 8, wherein the degree of reopening (I) of the movable shutter (7) is an angle ($\alpha$) of 10°.

10. The device according to claim 3, wherein a length of the cavity (27) is at least equal to a sum of a length of the calibrated spring device (26) when compressed, a thickness of the head of the rod (28) and the maximum stroke distance (C') of the rod (12).

11. The device according to claim 7, wherein the movable shutter has an axis of rotation (A) and an axis of symmetry (B), and the axis of rotation (A) of the shutter (7) is different from the axis of symmetry (B) of the movable shutter (7) by a gap distance (d).

12. The device according to claim 9, wherein the gap distance (d) is between 0.0197 and 0.197 inch.

13. The device according to claim 10, wherein the actuator cylinder (9) includes first and second bearings (17,19) for guiding axial movement of the rod (12), the first bearing (17) is supported by the piston (11) and the second bearing (19) is supported by a fixed ring (18) that closes the liner (9) of the actuator cylinder (9).

14. A decelerator device (1) mounted in an exhaust gas circuit of a vehicle equipped with a combustion engine, the decelerator device (1) comprising:

at least one valve (2) provided with a movable shutter (7) and an actuator cylinder (9) for operating the movable shutter (7), the actuator cylinder comprising a movable piston (11) provided with a rod (12) coupled to the movable shutter (7) to control operation of the movable shutter (7);

the actuator cylinder (9) comprising at least one balancing device (25) for balancing a back pressure exerted by the movable shutter (7) on gas flowing through the exhaust gas circuit; the at least one balancing device operates when the movable shutter (7) is in a closed position, once a predetermined back pressure threshold is reached within the exhaust gas circuit; to allow the movable shutter (7) to move to a partially reopened position (I) and to create a suitable exhaust gas leak flow rate past the movable shutter (7) and regulate the back pressure regardless of a speed of the combustion engine;

wherein the balancing device (25) is incorporated into the actuator cylinder (9) and is located between the movable piston (11) and the rod (12) of the cylinder, the rod (12) moves at stroke distance (C') relative to the movable piston (11), the stroke distance (C') of the rod corresponds to a degree of reopening of the movable shutter (7) and is controlled by at least one calibrated spring device (26) interacting between the movable piston (11) and the rod (12) of the cylinder.

15. The device according to claim 14, wherein the movable piston (11) defines a cavity (27) and the rod (12) comprises a head (28) housed within the cavity, the calibrated spring device (26) is located within the cavity and engages an adjacent surface of the head.

16. The device according to claim 15, wherein the movable piston (11) comprises two separate parts (11*a*, 11*b*) which, when assembled with one another, together define the cavity (27).

17. The device according to claim 15, wherein the calibrated spring device (26) is calibrated so that the calibrated spring device (26) becomes at least partially compressed when a force, corresponding to the predetermined back pressure threshold, is reached.

18. The device according to claim 14, wherein a maximum stroke distance (C') of the rod (12) is between 0 and 0.3937 inch.

19. The device according to claim 18, wherein the movable shutter (7) is a rotary shutter, and the degree of reopening (I) of the movable shutter (7) is an angle ($\alpha$) of between 0 and 20°.

20. The device according to claim 14, wherein movable shutter has an axis of rotation (A) and an axis of symmetry (B), and the axis of rotation (A) of the shutter (7) is different from the axis of symmetry (B) of the movable shutter (7) by a gap distance (d).

* * * * *